US006316883B1

(12) United States Patent
Cho et al.

(10) Patent No.: US 6,316,883 B1
(45) Date of Patent: Nov. 13, 2001

(54) POWER-FACTOR CORRECTION CIRCUIT OF ELECTRONIC BALLAST FOR FLUORESCENT LAMPS

(75) Inventors: Gyu Hyeong Cho, Taejon; Gyun Chae, Seoul, both of (KR)

(73) Assignee: Korea Advanced Institute of Science and Technology (KR)

( * ) Notice: Subject to any disclaimer, the term of this patent is extended or adjusted under 35 U.S.C. 154(b) by 0 days.

(21) Appl. No.: 09/627,460

(22) Filed: Jul. 28, 2000

(30) Foreign Application Priority Data

Aug. 27, 1999 (KR) ..... 99-35987
Apr. 14, 2000 (KR) ..... 2000-19666

(51) Int. Cl.[7] ..... H05B 41/16

(52) U.S. Cl. ..... 315/247; 315/307; 315/244; 315/209 R; 315/DIG. 7; 315/278; 363/45

(58) Field of Search ..... 315/247, 307, 315/244, 224, 225, 308, DIG. 7, 291, 274–278; 363/34, 44–47

(56) References Cited

U.S. PATENT DOCUMENTS 5,258,692 * 11/1993 Jones ..... 315/247
5,374,875 * 12/1994 Shackle et al. ..... 315/247
5,412,287 * 5/1995 Shackle ..... 315/247

(List continued on next page.)

OTHER PUBLICATIONS

Analysis and Design of Current–Fed Push–Pull Resonant Inverters—Cold Cathode Fluorescent Lamp Drivers, Yung L. Lin & Arthur F. Witulski, Department of Electrical & Computer Engineering, Univ. of Arizona, pp. 2149, 2150, 2152.

One–Stage Electronic Ballast Using a Push–Pull Converter, By Wen–Jian Gu and Rui Liu, Philips Labs, pp. 644–649.

Comparison Among Self–Excited Parallel Resonant, Series Resonant and Current–Fed Push–Pull Electronic Ballast, By T.–H. Yu & L.–M. Wu, Energy & Resources Labs., and T. – F. Wu, Power Electronics Applied Research Lab. National Chung Cheng Univ. (1994), pp. 421–426.

Electronic Ballast for Fluorescent Lamps, by Marian K. Kazimierczuk, IEEE Transactions on Power Electronics, vol. 8, No. 4 (Oct. 1993), pp. 386–395.

(List continued on next page.)

*Primary Examiner*—Don Wong
*Assistant Examiner*—Ephrem Alemu
(74) *Attorney, Agent, or Firm*—Bachman & LaPointe, P.C.

(57) ABSTRACT

A power-factor correction circuit of an electronic ballast for fluorescent lamps which includes an input full-wave rectification circuit for full-wave rectifying an AC input voltage from an AC input power source, a DC-link capacitor for supplying a DC-link voltage in response to an output voltage from the rectification circuit and a resonant inverter connected in parallel to the DC-link capacitor. The power-factor correction circuit comprises a charge pumping circuit disposed between the AC input power source and the rectification circuit, a valley-fill DC voltage supply circuit disposed between the rectification circuit and the DC-link capacitor, and a high-frequency full-wave rectification circuit disposed between the DC voltage supply circuit and the DC-link capacitor and connected to a secondary winding of a power transformer in the resonant inverter. The high-frequency full-wave rectification circuit includes a first pole connected to the secondary winding of the power transformer and a second pole connected to a common connection point of a plurality of stabilizing capacitors connected in series respectively to the fluorescent lamps. Therefore, a power factor of the ballast is improved and power supply is automatically controlled according to the number of fluorescent lamps being turned on.

10 Claims, 8 Drawing Sheets

U.S. PATENT DOCUMENTS

| | | | | |
|---|---|---|---|---|
| 5,521,467 | * | 5/1996 | Statnic et al. | 315/247 |
| 5,714,846 | * | 2/1998 | Rasch et al. | 315/225 |
| 5,757,143 | * | 5/1998 | Martucci et al. | 315/247 |
| 6,181,079 | * | 1/2001 | Chang et al. | 315/247 |

OTHER PUBLICATIONS

Current–Sourcing Push–Pull Parallel–Resonance Inverter (CS–PPRI): Theory and Application as a Discharge lamp Driver, By Michael Gulko & Sam Ben–Yaakov, IEE Trans. on Indust. Electronics, vol. 41, No. 3, (Jun. 1994).

* cited by examiner

POWER-FACTOR CORRECTION CIRCUIT OF ELECTRONIC BALLAST FOR FLUORESCENT LAMPS

BACKGROUND OF THE INVENTION

1. Field of the Invention

The present invention relates in general to the improvement in a power factor of an electronic ballast for fluorescent lamps, and more particularly to a power-factor correction circuit of an electronic ballast for fluorescent lamps, in which a power transformer of a resonant inverter is coupled with charge pumping capacitors to improve a power factor of the ballast and automatically control power supply according to the number of fluorescent lamps being turned on.

2. Description of the Prior Art

Generally, electronic ballasts for fluorescent lamps have been recommended to satisfy the international standards such as IEC6100-3-2, which recommendation is recently on a trend of being changed to an obligatory rule. According to such a trend, there is a need for the development of techniques capable of meeting requirements such as a restriction in higher harmonic components of input current to an electronic ballast, an improvement in a power factor of the ballast, etc.

Well-known power-factor correction systems or filtering systems may generally be classified into a passive type and an active type. The passive systems mostly employ a structure using a low pass filter composed of only an inductor and a capacitor and a valley-fill structure. The low pass filter structure is advantageous in terms of cost, but disadvantageous in that apparent power being required is very large as compared with effective power, a longer harmonic distortion occurs and a rectified voltage has a great fluctuation with a load. Because of these disadvantages, the low pass filter structure is not so well used for systems requiring a high power-factor and stabilized power. On the other hand, the valley-fill structure is generally applied to circuits considering the volume and weight of an electronic ballast. However, the valley-fill structure has a disadvantage in that a direct current (DC) voltage waveform repeats a drop from a peak value to half that value, resulting in a flickering at 120 Hz under a high-frequency lighting condition. Such a flickering makes characteristics of discharge lamps instable, leading to a degradation in lighting efficiency.

Consequently, because power-factor correction circuits cannot satisfy a variety of requirements in the case of employing the above passive systems, they mostly utilize an active system employing a boost converter.

An active power-factor correction circuit employing the above boost converter is advantageous in that a DC-link voltage has a low ripple component and a good rectification characteristic and a flickering phenomenon is minimal, but has a disadvantage in that it is so considerably complicated in construction as to increase the cost of the overall product.

On the other hand, the performance of inverters is the kernel of electronic ballasts for discharge lamps. Such inverters may generally be classified into a voltage source type and a current source type. Among these inverters, a parallel resonant inverter of the current source type has been employed in electronic ballasts for fluorescent lamps being widely used, in consideration of a low-voltage driving function, a function of driving a plurality of fluorescent lamps, a variation in resonance characteristic with a load variation, etc.

FIG. 1*a* is a circuit diagram schematically showing the construction of a conventional power-factor correction circuit employing a boost converter system.

In the boost converter system of FIG. 1*a,* if a transistor Q is turned on, then the amount of current flowing to an inductor $L_{boost}$ is increased, thereby causing energy to be accumulated on the inductor $L_{boost}$. Thereafter, when the transistor Q is turned off, the energy accumulated on the inductor $L_{boost}$ is transferred to an output stage through a freewheeling diode D. At this time, if the transistor Q is turned on before the amount of current through the freewheeling diode D becomes zero, a large amount of current flows from the diode D to the transistor Q for a period of reverse recovery time of the diode D, and it may break down the transistor Q.

The above problem can be overcome by controlling the amount of current $I_L$ through the inductor $L_{boost}$ in a discontinuous mode as shown in FIG. 1*b* by switching the transistor Q at the time that the amount of current through the freewheeling diode D becomes zero. However, in order to implement the above control operation, there is a need for a drive circuit for the transistor Q having a considerably complicated construction. Further, voltage and current stresses on devices may be increased and ratings of the devices may thus be raised, resulting in an increase in the cost of a product. This degrades the price competitiveness of the product.

On the other hand, in order to solve the above-mentioned degradation in the price competitiveness of the product resulting from the addition of the control circuit and the increase in the device ratings, there has been proposed a power-factor correction circuit as shown in FIG. 2*a*.

FIG. 2*a* is a circuit diagram showing the construction of a conventional low-price, electronic ballast employing the boost converter system.

With reference to FIG. 2*a,* the conventional electronic ballast can implement the power-factor improvement in the same manner as the above-mentioned power-factor correction circuit employing the boost converter system, by using only an inductor, diodes and a transformer without an additional switching control device [see: Marcio A. Co, J. L. Freitas Vieira, et al., IEEE PESC Transactions, pp. 962–968, 1996].

In more detail, in FIG. 2*a,* an inverter for driving fluorescent lamps includes two switches Q1 and Q2 which are driven in a self-excited manner. The switches Q1 and Q2 are alternately switched to generate square-wave voltage pulses, which are then applied to a resonance circuit through a transformer Tx1. In response to the square-wave voltage pulses generated by the switches Q1 and Q2, the resonance circuit generates a resonance voltage and resonance current of predetermined values at a high frequency and applies them to the fluorescent lamps. A power-factor correction circuit is connected between a set of rectifying diodes D1–D4 and a DC-link capacitor Cdc. The power-factor correction circuit includes a tertiary winding n3 of the transformer Tx1 provided for application of the square-wave voltage to the resonance circuit, and an inductor Lb and full-wave rectification diode circuit coupled with the tertiary winding n3 of the transformer Tx1, which has double the number of turns of a primary winding n1 of the transformer Tx1. The tertiary winding n3 of the transformer Tx1 generates a square-wave voltage corresponding to a predetermined turn ratio (n1:n3=1:2) as the switches Q1 and Q2 are switched. For one cycle of the square-wave voltage generated by the tertiary winding n3, a full-wave rectified version of an input voltage Vsrc from an alternating current (AC) input power source is applied to the inductor Lb and the corresponding current thus flows thereto, resulting in the formation of input current to the inverter.

The circuitry of FIG. 2*a* as mentioned above has a great effect in curtailing the cost because it is much simpler in construction than a conventional one comprising a separate boost converter. However, the above circuitry has a disadvantage in that a small and light capacitor cannot be replaced for the inductor Lb. In other words, the inductor Lb is structurally essentially required since the above circuitry employs the principle replaced for the separate boost converter and a square-wave voltage is generated across the tertiary winding n3 of the transformer Tx1 according to the switching operation of the switches Q1 and Q2. The circuitry of FIG. 2*a* has a further disadvantage in that the power-factor correction circuit cannot recognize a load connection state. This may cause a great variation in a DC-link voltage Vdc across the DC-link capacitor Cdc in the case where two fluorescent lamps are connected in parallel and one or both of them are selectively turned on.

FIG. 2*b* is a circuit diagram showing the construction of a conventional high power-factor electronic ballast employing a charge pumping capacitor, which improves a power factor using only the capacitor instead of an inductor on the basis of a charge pumping concept. This electronic ballast is disclosed in U.S. Patent, issued to Minoru Maechara, 1993.

With reference to FIG. 2*b,* the electronic ballast is provided with two main parts, or a power-factor correction circuit and a resonant inverter. The resonant inverter comprises a transformer Tx1 having a secondary winding connected to two fluorescent lamps connected in series, and preheating coils and capacitors connected respectively to filaments of the fluorescent lamps. The resonant inverter further comprises switches Q1 and Q2, a resonance circuit and a capacitor Cb for DC component prevention connected to a primary winding of the transformer Tx1. The resonance circuit is provided with a resonance inductor Lr and a resonance capacitor Cr. The switches Q1 and Q2 are controlled in a separate-excited manner to generate a resonance voltage, which is then applied to the fluorescent lamps through the secondary winding of the transformer Tx1 with an appropriate turn ratio.

The power-factor correction circuit has a simple construction consisting of only a charge pumping capacitor Cin and a diode Dc and performs the following operation. Assuming that a voltage Va across the resonance capacitor Cr is an individual high-frequency voltage source, the charge pumping capacitor Cin connected to the resonance capacitor Cr acts as a charge pump to allow the flow of current from an AC input power source to a DC-link capacitor Cdc through rectifying diodes D1–D4 and the diode Dc. In the case where a DC-link voltage Vdc across the DC-link capacitor Cdc is set to a value higher than a peak value of an input voltage Vsrc from the AC input power source by adjusting a capacitance of the charge pumping capacitor Cin, none of the diode Dc and rectifying diodes D1–D4 conduct, thereby causing the amount of charges being charged and discharged on/from the charge pumping capacitor Cin to vary in proportion to a variation of the input voltage Vsrc. As a result, because the average amount of input current traces the input voltage Vsrc, a power factor approximate to 1 can be obtained.

However, the above-mentioned power-factor correction circuit has a disadvantage in that a great variation may occur in the DC-link voltage Vdc as in the circuitry of FIG. 2*a* in the case where two fluorescent lamps are connected in parallel and one or both of them are selectively turned on. This power-factor correction circuit has a further disadvantage in that the charge pumping capacitor Cin exerts such an influence on the resonance operation according to a variation of the input voltage Vsrc as to generate a considerably high ripple component of 120 Hz in current flowing to the fluorescent lamps, resulting in an increase in crest factor (CF) of lamp current.

In order to overcome the above problems, there has been proposed a method for clamping the voltage Va to the DC-link voltage Vdc by adding diodes Da1 and Da2 to the structure of FIG. 2*b* as shown in FIG. 2*c*. However, this method encounters the occurrence of a conduction loss resulting from the production of a loop where current flowing to the resonance inductor Lr freewheels through the switches Q1 and Q2 and the diodes Da1 and Da2.

SUMMARY OF THE INVENTION

Therefore, the present invention has been made in view of the above problems, and it is an object of the present invention to provide a power-factor correction circuit of an electronic ballast for fluorescent lamps, which is capable of implementing the performance of an active system and the price competitiveness of a passive system using a resonant inverter.

It is another object of the present invention to provide a power-factor correction circuit of an electronic ballast for fluorescent lamps, in which a resonant inverter of a current source type is provided to drive a plurality of fluorescent lamps and a secondary winding of a transformer contained in the resonant inverter is used to improve a power factor of the electronic ballast, so that the power-factor correction circuit can be implemented in a full-passive manner.

It is a further object of the present invention to provide a power-factor correction circuit of an electronic ballast for fluorescent lamps, in which an automatic power control circuitry is provided to automatically control power supply to cope with a transition from a heavy load state where a plurality of fluorescent lamps are turned on to a light load state where at least one of the turned-on fluorescent lamps is turned off, thereby making the entire circuit construction simple and thus raising the price competitiveness of a product.

It is yet another object of the present invention to provide a power-factor correction circuit of an electronic ballast for fluorescent lamps, in which a secondary winding of a transformer in a resonant inverter of a current source type is used to allow a rectified version of high-frequency current flowing to the secondary winding of the transformer to flow to an input stage, so that a power factor at the input stage can be approximated to 1.

In accordance with the present invention, the above and other objects can be accomplished by a provision of a power-factor correction circuit of an electronic ballast for fluorescent lamps which includes an input full-wave rectification circuit for full-wave rectifying an AC input is voltage from an AC input power source, a first DC-link capacitor for supplying a DC-link voltage in response to an output voltage from the rectification circuit and a resonant inverter connected in parallel to the first DC-link capacitor, comprising charge pumping means disposed between the AC input power source and the rectification circuit, the charge pumping means including a pair of charge pumping capacitors connected in series to each other and connected at their intermediate connection point to an intermediate connection point of a pair of series connected resonance capacitors in the resonant inverter; valley-fill DC voltage supply means disposed between the rectification circuit and the first DC-link capacitor, the DC voltage supply means including second and third DC-link capacitors, a pair of intermediate diodes for interconnecting the 5 second and third DC-link capacitors, and a valley charge pumping capacitor connected between an intermediate connection point of the intermediate diodes and an intermediate connection point of a primary winding of a power transformer in the resonant inverter; and high-frequency full-wave rectification means disposed between the valley-fill DC voltage supply means and the first DC-link capacitor and connected to a secondary winding of the power transformer in the resonant inverter, the high-frequency full-wave rectification means including a first pole connected to the secondary winding of the power transformer and a second pole connected to a common connection point of a plurality of stabilizing capacitors, each of the stabilizing capacitors being connected in series to a corresponding one of the fluorescent lamps to stabilize lamp current.

Preferably, the fluorescent lamps have first and second electrodes short-circuited through filaments, respectively. The first electrodes are connected in common to the secondary winding of the power transformer and the second electrodes are connected respectively to the stabilizing capacitors.

Alternatively, the intermediate connection point of the charge pumping capacitors in the charge pumping means may be connected to the intermediate connection point of the primary winding of the power transformer in the resonant inverter, and the valley charge pumping capacitor in the valley-fill DC voltage supply means may be connected to the intermediate connection point of the resonance capacitors in the resonant inverter.

Preferably, the valley-fill DC voltage supply means may include a valley diode connected in series to the third DC-link capacitor. In this case, the second DC-link capacitor is connected at its negative terminal to an intermediate connection point of the valley diode and third DC-link capacitor and the high-frequency full-wave rectification means is connected between a cathode of the valley diode and a positive terminal of the second DC-link capacitor. Further, the valley-fill DC voltage supply means may include a secondary coil appended to a current supply inductor connected between the positive terminal of the second DC-link capacitor and the resonant inverter, the secondary coil having its one terminal connected to the intermediate connection point of the valley diode and third DC-link capacitor via a rectifying diode and its other terminal connected to a ground terminal.

Further preferably, the valley-fill DC voltage supply means may include a pair of high-frequency diodes connected in series between an intermediate connection point of the third DC-link capacitor and second DC-link capacitor and the ground terminal. In this case, the valley charge pumping capacitor is connected between an intermediate connection point of the high-frequency diodes and the intermediate connection point of the primary winding of the power transformer.

Alternatively, the valley-fill DC voltage supply means may include a pair of high-frequency diodes connected in series between an intermediate connection point of the third DC-link capacitor and second DC-link capacitor and the ground terminal for charging the third DC-link capacitor, the high-frequency diodes being connected at their intermediate connection point to the intermediate connection point of the resonance capacitors in the resonant inverter.

Preferably, the power-factor correction circuit may further comprise a plurality of auxiliary capacitors for improving a crest factor of the lamp current. In this case, first filament terminals of the first and second electrodes of the fluorescent lamps are connected respectively to the auxiliary capacitors, second filament terminals of the first electrodes are connected in common to the secondary winding of the power transformer and second filament terminals of the second electrodes are connected respectively to the stabilizing capacitors.

Alternatively, the first filament terminals of the first electrodes may be connected respectively to first terminals of the auxiliary capacitors, the second filament terminals of the first electrodes may be connected in common to one terminal of the secondary winding of the power transformer, and the first filament terminals of the second electrodes may be connected respectively to first terminals of the stabilizing capacitors. In this case, there may be provided a plurality of auxiliary windings, each being connected between an intermediate connection point of each of the first filament terminals of the second electrodes of the fluorescent lamps and each of the first terminals of the stabilizing capacitors and a corresponding one of the second filament terminals of the second electrodes of the fluorescent lamps. Each of the auxiliary windings may have a smaller number of turns than that of the secondary winding of the power transformer. The auxiliary capacitors and the stabilizing capacitors may have their second terminals connected in common to an intermediate point of the second pole of the high-frequency full-wave rectification means, and the secondary winding of the power transformer may have its other terminal connected to an intermediate point of the first pole of the high-frequency full-wave rectification means.

Preferably, a bypass capacitor may be connected between an intermediate connection point of the first pole of the high-frequency full-wave rectification means and the secondary winding of the power transformer and an intermediate connection point of the second pole of the high-frequency full-wave rectification means and the common connection point of the stabilizing capacitors.

Preferably, the power-factor correction circuit further may comprise an auxiliary winding electrically isolated from the primary winding of the power transformer in the resonant inverter of the current source type and appended to the secondary winding of the power transformer for generating a high-frequency voltage of a level nearly equal to that of the DC-link voltage from the DC-link capacitor, the auxiliary winding having its one end connected to the first pole of the high-frequency full-wave rectification means and its other end connected to a common connection point of first filament terminals of first electrodes of the fluorescent lamps whose second filament terminals are connected in common to the second pole of the high-frequency full-wave rectification means respectively through a plurality of charge pumping capacitors, the fluorescent lamps having second electrodes connected in common to the secondary winding of the power transformer respectively through the stabilizing capacitors, whereby the auxiliary winding is connected to the high-frequency full-wave rectification means through the charge pumping capacitors in the case where the fluorescent lamps are connected in parallel.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION OF THE PREFERRED EMBODIMENTS

Figure 1A:
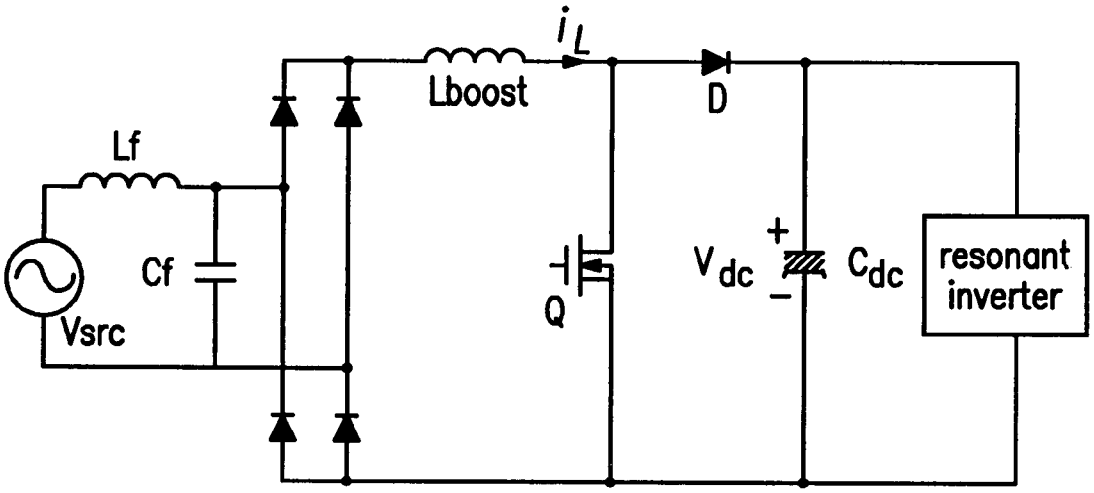
FIG. 1A PRIOR ART
FIG. 1*a* is a circuit diagram schematically showing the construction of a conventional power-factor correction circuit employing a boost converter system.
Figure 1B:
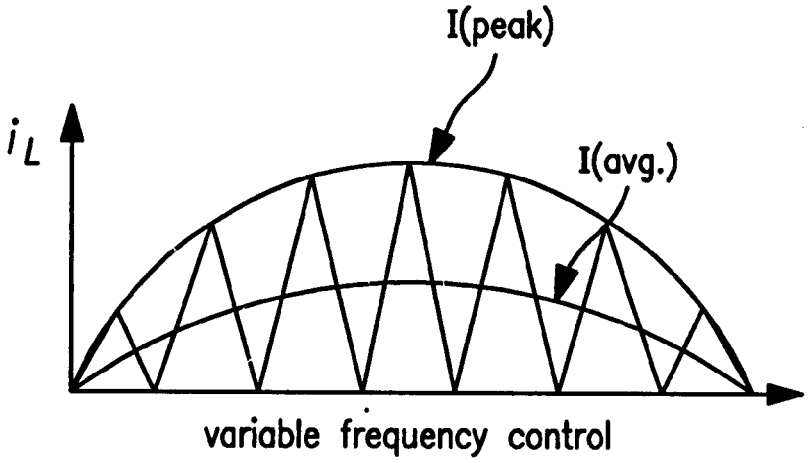
FIG. 1B PRIOR ART
FIG. 1*b* is a waveform diagram of inductor current in FIG. 1*a* based on a variable frequency control manner.
Figure 2A:
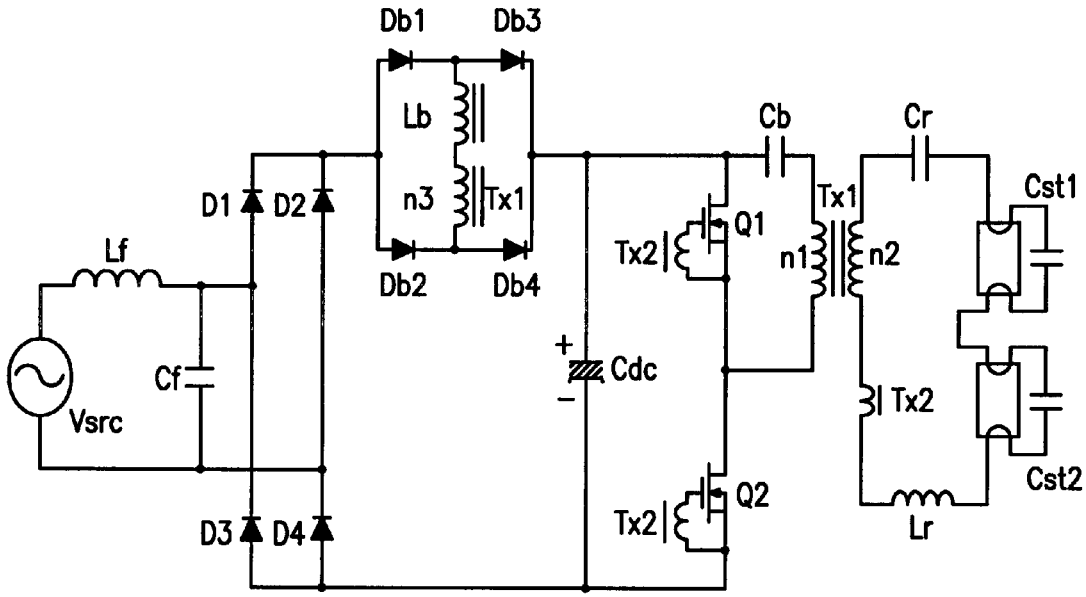
FIG. 2A PRIOR ART
FIG. 2*a* is a circuit diagram showing the construction of a conventional low-price, electronic ballast employing the boost converter system.
Figure 2B:
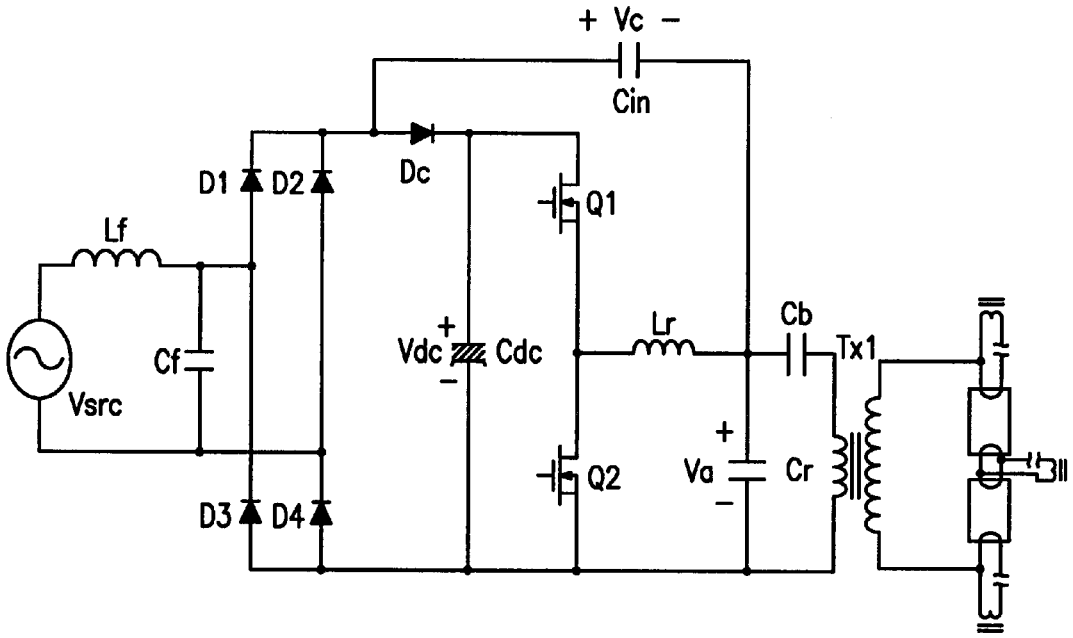
FIG. 2B PRIOR ART
FIG. 2*b* is a circuit diagram showing the construction of a conventional high power-factor electronic ballast employing a charge pumping capacitor.
Figure 2C:
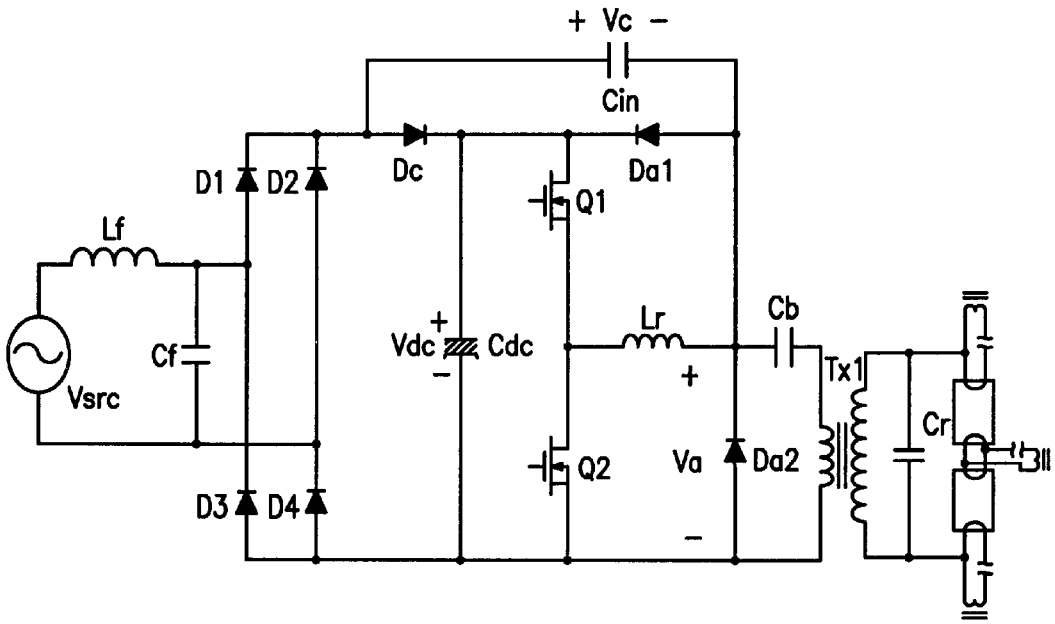
FIG. 2C PRIOR ART
FIG. 2*c* is a circuit diagram illustrating a method for improving a crest factor of fluorescent lamp current by adding clamping diodes to the construction of FIG. 2*b;*

The preferred embodiments of the present invention will hereinafter be described with reference to the accompanying drawings.

In the drawings, some parts are substantially the same in construction and operation. Therefore, the same parts are denoted by the same reference numerals and a detailed description thereof will thus be omitted.

First, a brief description will be given of a basic construction of an electronic ballast for fluorescent lamps employing a resonant inverter of a current source type to be used in the present invention, in conjunction with FIG. 3.

Figure 3:
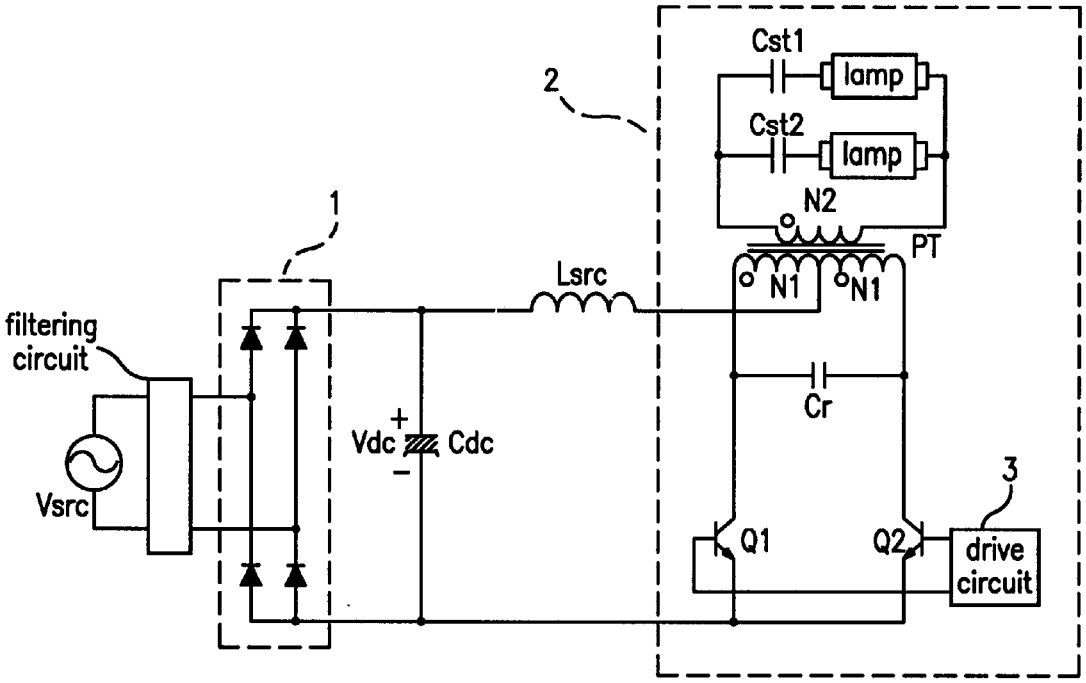
FIG. 3 is a circuit diagram showing a basic construction of an electronic ballast employing a high-frequency resonant inverter of a current source type.

With reference to FIG. 3, the electronic ballast comprises an input full-wave rectification circuit 1 for receiving an AC input voltage Vsrc from an AC input power source through a filtering circuit and full-wave rectifying it, a DC-link capacitor Cdc connected in parallel to the output of the rectification circuit 1 for removing a ripple component of a commercial frequency from the input voltage Vsrc and storing energy thereon, and a current supply inductor Lsrc connected in series to the output of the rectification circuit 1 for supplying stabilized current to a resonant inverter 2 of a current source type.

The resonant inverter 2 includes power switches Q1 and Q2, a drive circuit 3 for turning on/off the power switches Q1 and Q2, a resonance inductor Cr and power transformer PT for cooperating to perform a resonance operation, and load fluorescent lamps and stabilizing capacitors Cst1 and Cst2 connected to a secondary winding N2 of the power transformer PT. The stabilizing capacitors Cst1 and Cst2 function to stabilize lamp current. The drive circuit 3 may employ any one of either a self-oscillation switching system or a separate-excited driving system to drive the resonant inverter 2 in an appropriate manner. The self-oscillation switching system comprises an additional winding provided in the power transformer PT for sensing the amount of current generated due to a resonance phenomenon to drive the switches Q1 and Q2 on the basis of the sensed current amount. The separate-excited driving system comprises a separate drive circuit for externally controlling a switching operation of the resonant inverter 2.

The resonant inverter 2 has its characteristic varying sensitively to the magnitude of a ripple component in a DC-link voltage. For the purpose of making the magnitude of the ripple component smaller, it is common that the DC-link capacitor Cdc for storage of large-capacity energy is inevitably connected between both ends of the input full-wave rectification circuit 1 to constitute a smoothing circuit. This has a disadvantage in that the supply efficiency of AC input power is significantly reduced because, for example, a power factor at the AC input power source becomes about 0.55–0.6 due to the amount of charging current on the DC-link capacitor Cdc. For this reason, it is common that a boost converter is used or a large-capacity L-C filter is disposed between the input full-wave rectification circuit 1 and the DC-link capacitor Cdc to improve the power factor at the AC input power source and remove higher harmonic components from input current. However, the use of the boost converter results in an increase in the cost of the overall product, and the use of the large-capacity L-C filter is not desirable in view of the volume, weight and efficiency of the overall product.

Figure 4:
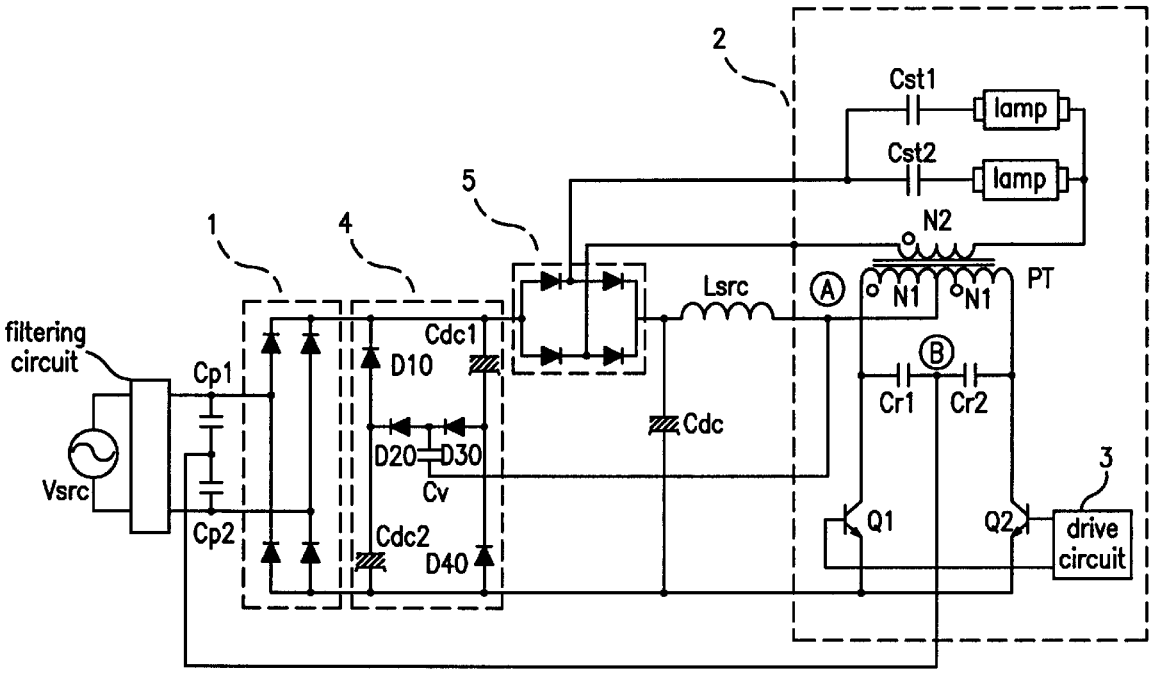
FIG. 4 is a circuit diagram showing the construction of an electronic ballast in accordance with a first embodiment of the present invention.

FIG. 4 is a circuit diagram showing the construction of an electronic ballast of a current source type in accordance with a first embodiment of the present invention, wherein a power-factor correction circuit is provided in addition to the construction of FIG. 3.

With reference to FIG. 4, series connected charge pumping capacitors Cp1 and Cp2 are coupled with the input of the input full-wave rectification circuit 1, and a valley-fill DC voltage supply circuit 4 is connected to the output of the input full-wave rectification circuit 1. A high-frequency full-wave rectification circuit 5 is connected between the DC-link capacitor Cdc and the valley-fill DC voltage supply circuit 4 and also to the secondary winding N2 of the power transformer PT in the resonant inverter 2.

The charge pumping capacitors Cp1 and Cp2 are connected at their intermediate connection point to an intermediate connection point B of resonance capacitors Cr1 and Cr2 in the resonant inverter 2. The valley-fill DC voltage supply circuit 4 is composed of DC-link capacitors Cdc1 and Cdc2, a valley charge pumping capacitor Cv and a plurality of diodes D10–D40.

A detailed description will hereinafter be given of the operation of the electronic ballast with the above-mentioned construction in accordance with the first embodiment of the present invention.

First, in the case where the input voltage Vsrc is lower in level than voltages across the DC-link capacitors Cdc1 and Cdc2 in the valley-fill DC voltage supply circuit 4, the input full-wave rectification circuit 1 does not conduct, thereby causing input current to be generated by the charge pumping capacitors Cp1 and Cp2 connected at their intermediate connection point to the intermediate connection point B of the resonance capacitors Cr1 and Cr2 in the resonant inverter 2. The generation of the input current results from the induction of current on the charge pumping capacitors Cp1 and Cp2 according to a variation of a high-frequency voltage at the intermediate connection point B of the resonance capacitors Cr1 and Cr2 in the resonant inverter 2. At this time, energy accumulated on the DC-link capacitors Cdc1 and Cdc2 in the valley-fill DC voltage supply circuit 4 and energy stored on the DC-link capacitor Cdc are supplied as load driving energy to the resonant inverter 2. If the input voltage Vsrc is higher in level than the voltages across the DC-link capacitors Cdc1 and Cdc2 in the valley-fill DC voltage supply circuit 4, then a voltage at a point A in the resonant inverter 2 is changed to a high-frequency level. At this time, in the valley-fill DC voltage supply circuit 4, energy from the valley charge pumping capacitor Cv is accumulated on the DC-link capacitors Cdc1 and Cdc2 respectively through the diodes D20 and D30 for every half cycle of the input voltage Vsrc. In this regard, the capacitor voltage of the valley-fill DC voltage supply circuit 4 can be regulated to a level higher than half a peak value of the input voltage Vsrc by adjusting a capacity of the valley charge pumping capacitor Cv. Noticeably, the use of only the valley-fill DC voltage supply circuit 4 causes a high ripple component of 120 Hz to be generated in a DC voltage being supplied to the resonant inverter 2 of the current source type, resulting in the resonance operation being not regularly performed. As a result, energy is not uniformly supplied to the load lamps, thereby increasing a crest factor (CF) of the lamp current to a considerable degree, which leads to a reduction in the life of the lamps. In order to make up for this problem, the resonant inverter of the current source type has to comprise a large-capacity DC-link capacitor Cdc provided at its input stage for supplying a fixed level of DC voltage to the resonant inverter. In this case, however, pulsating charging current flows from the AC input power source to the large-capacity DC-link capacitor Cdc, resulting in a degradation in the power factor at the AC input power source. In order to overcome the above problem, according to the present invention, the secondary winding N2 of the power transformer PT in the resonant inverter 2 is connected to the high-frequency full-wave rectification circuit 5, which is disposed between the valley-fill DC voltage supply circuit 4 and the DC-link capacitor Cdc. Hence, in the case where the input voltage Vsrc is higher in level than the voltages across the DC-link capacitors Cdc1 and Cdc2 in the valley-fill DC voltage supply circuit 4, the DC-link capacitor Cdc is charged with input current generated by high-frequency resonance current flowing to the secondary winding N2 of the power transformer PT in the resonant inverter 2. Provided that the valley-fill DC voltage supply circuit 4 is removed, the input current will have a waveform nearly analogous to a square wave, because the high-frequency resonance current flowing from the input stage to the secondary winding N2 of the power transformer PT in the resonant inverter 2 is almost constant in amount over the entire cycle of the input voltage Vsrc.

On the other hand, in FIG. 4, both electrodes of the respective load lamps in the resonant inverter are short-circuited in such a way that the first electrodes are connected respectively to the lamp stabilizing capacitors Cst1 and Cst2 and the second electrodes are connected in common to the secondary winding N2 of the power transformer PT, so that the lamps can instantaneously discharge. As an alternative, the points A and B in the resonant inverter 2 may be substituted with each other because voltages of the same waveform are induced therein. That is, the charge pumping capacitors Cp1 and Cp2 at the input stage may be connected to the point A and the valley charge pumping capacitor Cv may be connected to the point B. The circuitry of FIG. 4 can be modified in this way because there is little variation in operation.

In FIG. 4, current flowing to the lamps is the same as current flowing to the secondary winding N2 of the power transformer PT, which can be regarded to be almost the same as current being introduced from the input stage. Provided that the input voltage Vsrc varies, the resonance condition is changed or a relatively high ripple component is present on the DC-link capacitor Cdc, these will exert a direct influence on the current flowing to the lamps, thereby making lamp current instable.

Figure 5:
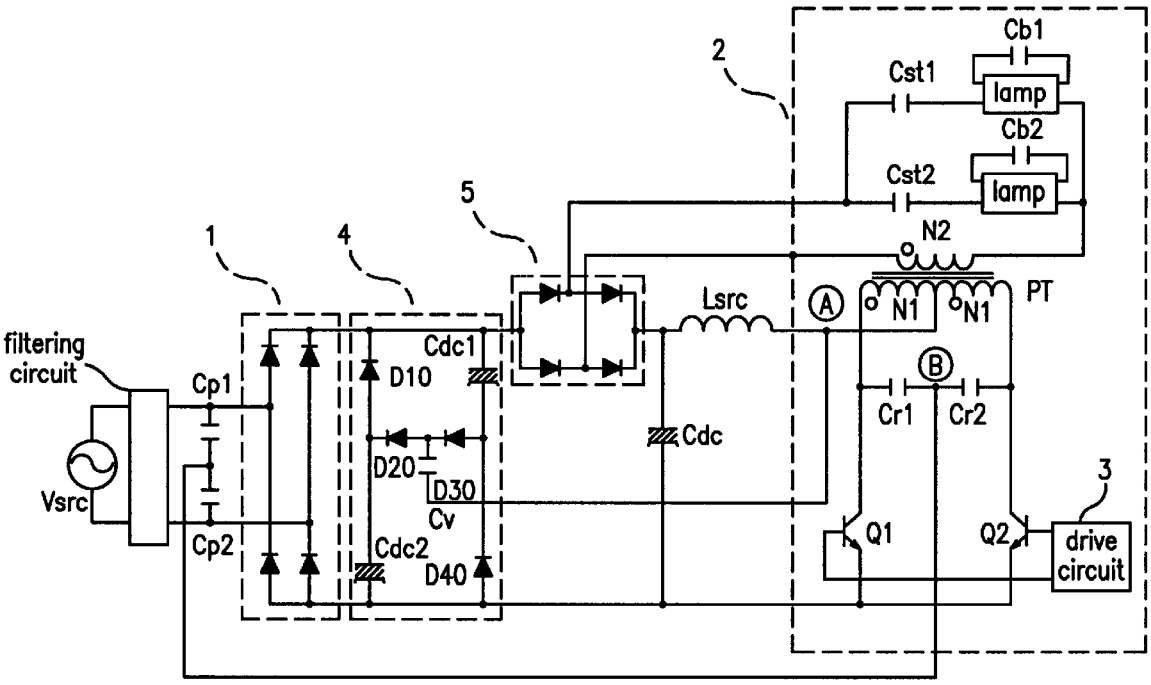
FIG. 5 is a circuit diagram showing the construction of an electronic ballast in accordance with a second embodiment of the present invention.

FIG. 5 is a circuit diagram showing the construction of an electronic ballast in accordance with a second embodiment of the present invention, which is proposed to solve the above problem. In this drawing, auxiliary capacitors Cb1 and Cb2 are connected between both electrodes of the load lamps through filaments, respectively. In the case where a voltage induced in the secondary winding N2 of the power transformer PT has a variation, the auxiliary capacitors Cb1 and Cb2 act to stabilize the lamp current against that variation, so as to improve the CF of the lamp current. The principle of improving the power factor at the AC input power source in FIG. 5 is implemented in the same manner as that of FIG. 4.

Both of the above-mentioned power-factor correction circuits of FIGS. 4 and 5 employ a passive system comprising the valley-fill DC voltage supply circuit 4, the charge pumping capacitors Cp1 and Cp2 and the high-frequency full-wave rectification circuit 5 connected to the secondary winding of the power transformer PT. However, these circuits are complicated in construction because they have a relatively large number of devices.

Figure 6:
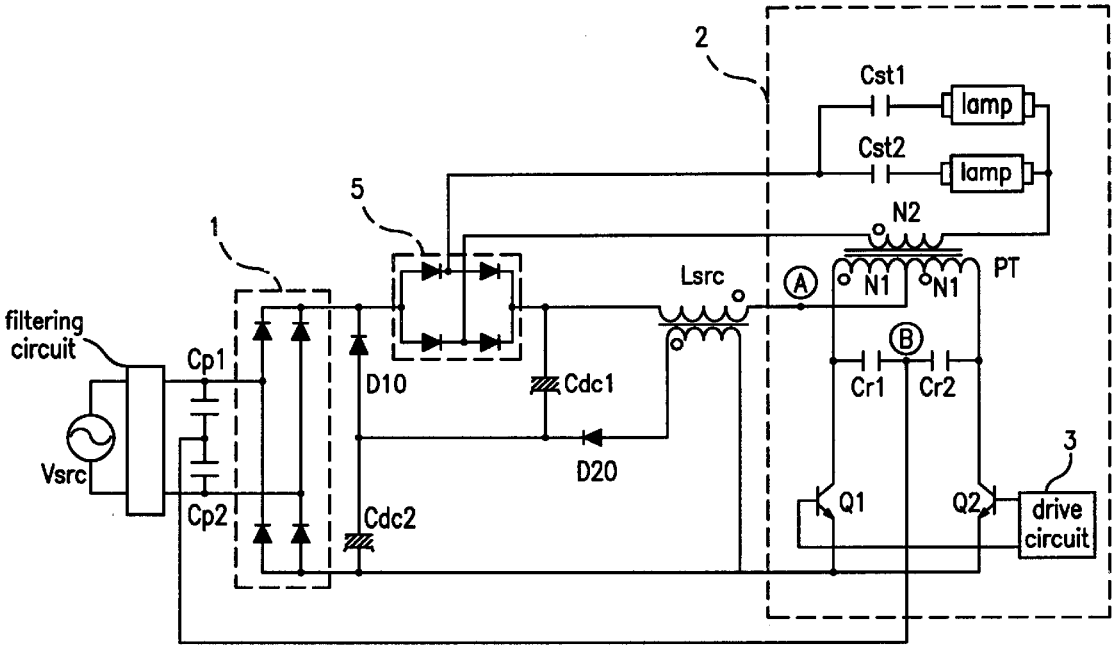
FIG. 6 is a circuit diagram showing the construction of an electronic ballast in accordance with a third embodiment of the present invention.

FIG. 6 is a circuit diagram showing the construction of an electronic ballast in accordance with a third embodiment of the present invention.

The electronic ballast shown in FIG. 6 utilizes the resonant inverter 2 of the current source type and the charge pumping capacitors Cp1 and Cp2 in the same manner as those in FIG. 4, but employs a new DC voltage source instead of the valley-fill DC voltage supply circuit 4 in FIG. 4. In FIG. 6, the DC-link capacitors Cdc1 and Cdc2 are connected in series to supply a DC voltage to the resonant inverter 2 of the current source type, and the high-frequency full-wave rectification circuit 5 is disposed between the first diode D10 and the first DC-link capacitor Cdc1 to charge the DC-link capacitors Cdc1 and Cdc2. In order to charge the second DC-link capacitor Cdc2 which discharges a relatively large amount of energy as compared with the first DC-link capacitor Cdc1, a secondary coil is appended to the current supply inductor Lsrc, which secondary coil is connected to the second DC-link capacitor Cdc2 through the second diode D20.

The electronic ballast shown in FIG. 6 comprises a power-factor correction circuit which is operated in the following manner. If the input voltage Vsrc is lower in level than a voltage across the second DC-link capacitor Cdc2, or a valley voltage, then input current is formed by current flowing through the charge pumping capacitors Cp1 and Cp2 connected to the high-frequency operation point B of the resonant inverter 2. At this time, current flowing through the secondary winding N2 of the power transformer PT charges the first DC-link capacitor Cdc1 via the high-frequency full-wave rectification circuit 5 and then flows through the first diode D10. In the case where the input voltage Vsrc is higher in level than the valley voltage, the input current is formed by current flowing through the charge pumping capacitors Cp1 and Cp2 and current flowing through the secondary winding N2 of the power transformer PT. At this time, most of the input current is formed by the current flowing through the secondary winding N2 of the power transformer PT since it is larger in amount than the current flowing through the charge pumping capacitors Cp1 and Cp2. When the input voltage Vsrc has a level near its peak value, charging current for the DC-link capacitors Cdc1 and Cdc2 can flow directly thereto via the input full-wave rectification circuit 1 in the case where the voltage of the DC voltage supply circuit is set to a level lower than the peak value of the input voltage Vsrc. For this reason, in order to maximize the power-factor correction effect, there is a necessity for setting the voltage of the DC voltage supply circuit to a level slightly higher than the peak value of the input voltage Vsrc by appropriately adjusting a turn ratio of a primary winding and secondary winding of the power transformer PT, capacitances of the stabilizing capacitors Cst1 and Cst2 and a turn ratio of the current supply inductor Lsrc and secondary coil for charging the second DC-link capacitor Cdc2.

Figure 7:
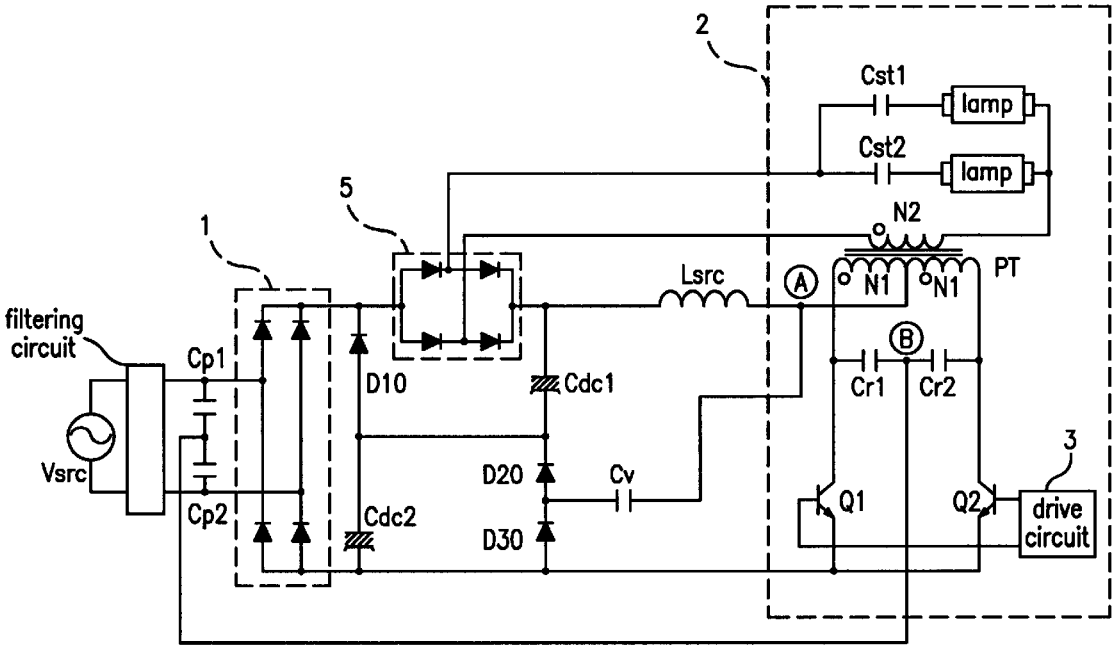
FIG. 7 is a circuit diagram showing the construction of an electronic ballast in accordance with a fourth embodiment of the present invention.

FIG. 7 is a circuit diagram showing the construction of an electronic ballast in accordance with a fourth embodiment of the present invention.

With reference to FIG. 7, the valley charge pumping capacitor Cv is connected to the point A, or an intermediate connection point of the primary winding N1 of the power transformer PT in the resonant inverter 2, and the two diodes D20 and D30 are used to charge the second DC-link capacitor Cdc2. A voltage at the point A in the resonant inverter 2 varies in the form of a high-frequency voltage with a fixed amplitude according to a resonance operation by a magnetizing inductance of the primary winding N1 of the power transformer PT and the resonance capacitors Cr1 and Cr2. This voltage charges the second DC-link capacitor Cdc2 through the valley charge pumping capacitor Cv on the basis of the charge pumping principle.

In the above constructions of FIGS. 6 and 7, there is little variation in basic operation even though the points A and B in the resonant inverter 2 are substituted with each other. Therefore, connections to the two points can freely be made in consideration of the lamp current CF and power factor.

Figure 8:
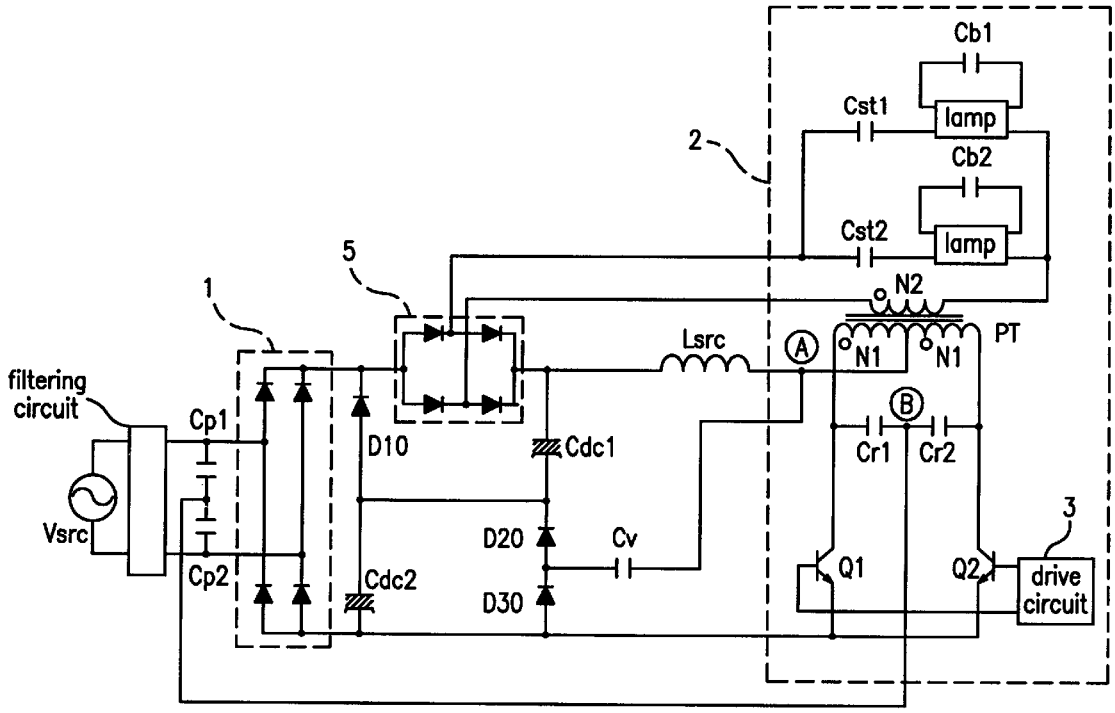
FIG. 8 is a circuit diagram showing the construction of an electronic ballast in accordance with a fifth embodiment of the present invention.

FIG. 8 is a circuit diagram showing the construction of an electronic ballast in accordance with a fifth embodiment of the present invention.

Generally, the lamp current reacts sensitively to a high ripple component in the input DC voltage and an instantaneous variation in the resonance condition. For this reason, in the electronic ballast shown in FIG. 8, the auxiliary capacitors Cb1 and Cb2 are connected between both electrodes of the load lamps, respectively, to stabilize the lamp current. Namely, each of the auxiliary capacitors Cb1 and Cb2 is connected in parallel between associated filament terminals of both electrodes of the corresponding lamp to alleviate a voltage variation in the secondary winding N2 of the power transformer PT resulting from the above-mentioned various causes, so as to make the lamp current stable. Further, the auxiliary capacitors Cb1 and Cb2 enhance the power-factor improving capability because they function to provide an additional current flow path for supplying a sufficient amount of energy to the capacitors Cdc1 and Cdc2 in the DC voltage supply circuit. On the other hand, in order to charge the second DC-link capacitor Cdc2, a secondary coil may be appended to the current supply inductor Lsrc in a similar manner to FIG. 6. In this case, the secondary coil is connected to the second DC-link capacitor Cdc2 through the second diode D20, as shown in FIG. 6.

Figure 9:
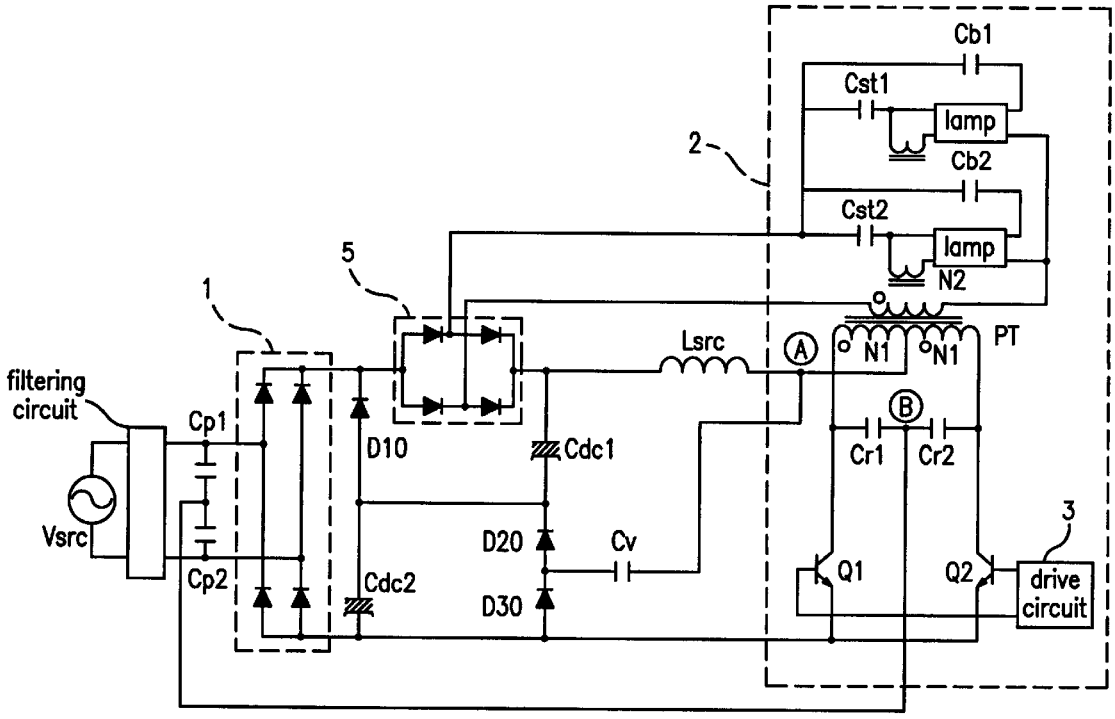
FIG. 9 is a circuit diagram showing the construction of an electronic ballast in accordance with a sixth embodiment of the present invention.

FIG. 9 is a circuit diagram showing the construction of an electronic ballast in accordance with a sixth embodiment of the present invention.

In FIG. 9, the load lamps include their first electrodes having first filament terminals connected respectively to first terminals of the auxiliary capacitors Cb1 and Cb2 and second filament terminals connected in common to one terminal of the secondary winding N2 of the power transformer PT. Further, the load lamps include their second electrodes having first filament terminals connected respectively to first terminals of the stabilizing capacitors Cst1 and Cst2. Each auxiliary winding is connected between an intermediate connection point of each of the first filament terminals of the second electrodes of the load lamps and each of the first terminals of the stabilizing capacitors Cst1 and Cst2 and a corresponding one of second filament terminals of the second electrodes of the load lamps. The auxiliary winding has a smaller number of turns than that of the secondary winding N2 of the power transformer PT. Second terminals of the auxiliary capacitors Cb1 and Cb2 and second terminals of the stabilizing capacitors Cst1 and Cst2 are connected in common to an intermediate point of a first pole of the high-frequency full-wave rectification circuit 5, and the other terminal of the secondary winding N2 of the power transformer PT is connected to an intermediate point of a second pole of the high-frequency full-wave rectification circuit 5. As seen from this construction, the circuitry of FIG. 9 employs a modified version of the load connection of FIG. 8 to obtain the same power-factor improvement effect as that of FIG. 8. In particular, the circuitry of FIG. 9 is characterized in that the initial discharge occurs easier than that in FIG. 8 because the initial voltage necessary to the discharging of the fluorescent lamp is higher in level than that in FIG. 8.

Figure 10:
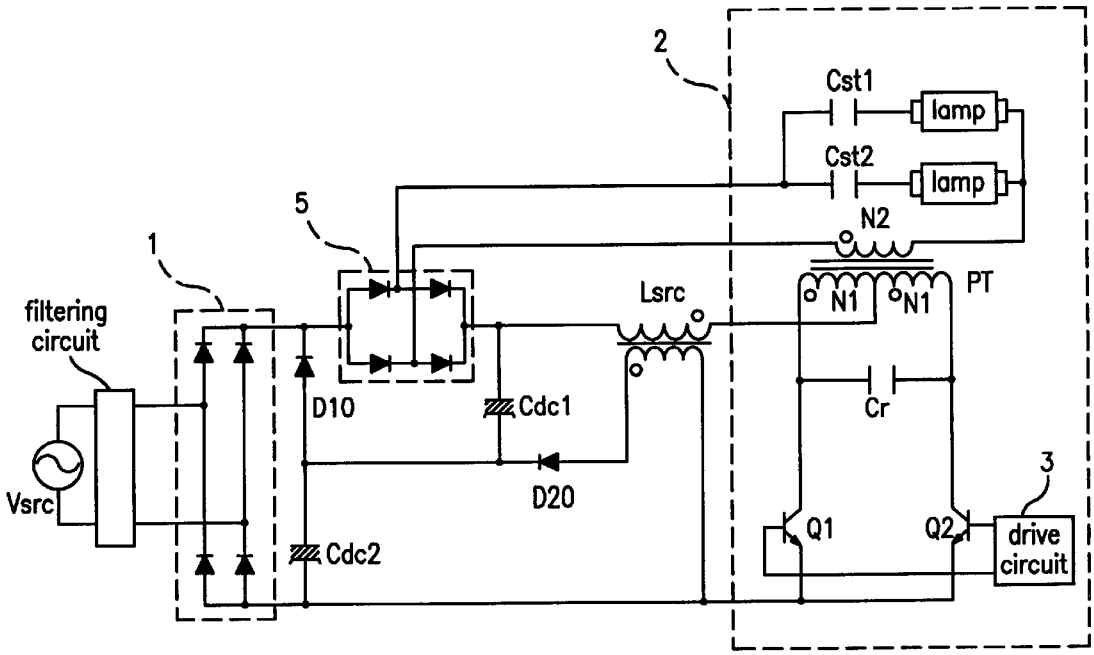
FIG. 10 is a circuit diagram showing the construction of an electronic ballast in accordance with a seventh embodiment of the present invention.

FIG. 10 is a circuit diagram showing the construction of an electronic ballast in accordance with a seventh embodiment of the present invention. In the constructions of FIGS. 6, 7 and 8, the charge pumping capacitors Cp1 and Cp2 connected to the output of the input filtering circuit are used to form the input current when the input voltage Vsrc is lower in level than the valley voltage, or the voltage across the second DC-link capacitor Cdc2. However, the voltage across the second DC-link capacitor Cdc2 actually has a level lower than that of the input voltage Vsrc, which level corresponds to about 1/6 that of the input voltage Vsrc. This signifies that the charge pumping capacitors Cp1 and Cp2 are used to form a path of the input current for an interval corresponding to about 1/18 the entire period of a full-wave rectified version of the input voltage Vsrc. As a result, because the removal of the charge pumping capacitors Cp1 and Cp2 has little effect on the power-factor characteristic of the AC input power source, the electronic ballast may have a power-factor correction circuit constructed as shown in FIG. 10. For an interval where the input voltage Vsrc is lower in level than the voltage across the second DC-link capacitor Cdc2, the power factor may be degraded and higher harmonic components may be increased in amount due to the formation of no input current. These can be minimized by adjusting a turn ratio of the current supply inductor Lsrc used for the charging of the second DC-link capacitor Cdc2 or a capacitance of the valley charge pumping capacitor Cv.

Further, in the construction of FIG. 10, the valley charge pumping capacitor Cv may be used as shown in FIG. 8 to charge the second DC-link capacitor Cdc2. Moreover, as shown in FIGS. 8 and 9, the auxiliary capacitors Cb1 and Cb2 may be additionally provided to enhance the lamp current CF and improve the power factor.

Figure 11:
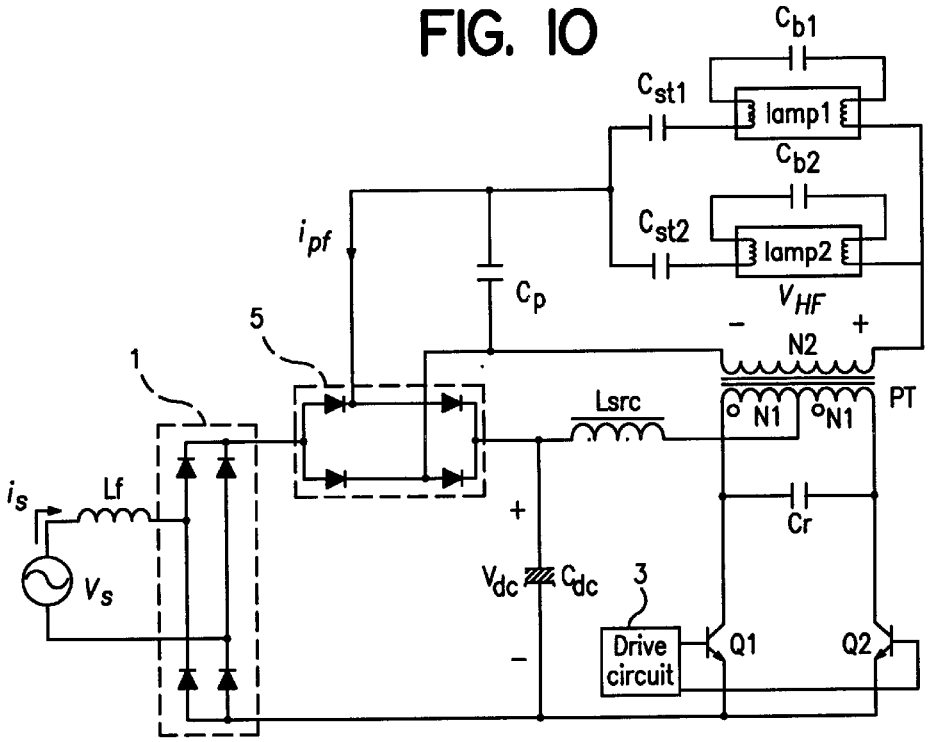
FIG. 11 is a circuit diagram showing the construction of an electronic ballast in accordance with an eighth embodiment of the present invention.

The preferred embodiments of the present invention have been disclosed to show the power-factor correction systems using the modified valley-fill DC voltage supply circuit and the secondary winding N2 of the power transformer PT in the resonant inverter. Generally, a voltage induced in the secondary winding N2 of the power transformer PT in the resonant inverter is much higher in level than that from the DC voltage supply circuit. In this regard, provided that the secondary winding N2 of the power transformer PT is connected directly to the high-frequency full-wave rectification circuit 5 disposed between the input full-wave rectification circuit 1 and the DC voltage supply circuit, the formed input current will have a waveform nearly analogous to a square wave. In order to improve this condition, the present invention proposes a DC voltage supply circuit wherein are connected in series the two DC-link capacitors Cdc1 and Cdc2 used in the valley-fill DC voltage supply circuit 4 in FIGS. 4 and 5 and shown in FIGS. 6, 7, 8, 9 and 10. Ultimately, this DC voltage supply circuit is proposed for the purpose of preventing the input current from abruptly varying when the input voltage Vsrc is nearly zero in level. In order to implement such a DC voltage supply circuit in a simpler manner, a bypass capacitor Cp can be connected between lines extending from the first and second poles of the high-frequency full-wave rectification circuit 5 as shown in FIG. 11, so that a considerable power-factor improvement effect can be obtained on the basis of the use of only a single DC-link capacitor Cdc. For one cycle of the input voltage Vsrc where it is considerably lowered to nearly zero in level, a voltage of the same level as that of a DC-link voltage Vdc across the DC-link capacitor Cdc is applied across the bypass capacitor Cp, thereby causing the corresponding high-frequency current to flow to the bypass capacitor Cp through the power transformer PT. Thereafter, the higher the input voltage Vsrc is in level, the lower the voltage across the bypass capacitor Cp is in level. As a result, the amount of current flowing through the bypass capacitor Cp is gradually smaller and the amount of current flowing from the input power source thus becomes relatively larger. This results in the formation of input current of the amount proportioned to the level of the input voltage Vsrc, which leads to the improvement in power factor. The bypass capacitor Cp must be designed to have a capacitance relatively larger than those of the auxiliary capacitors Cb1 and Cb2 disposed between both electrodes of the load lamps and those of the stabilizing capacitors Cst1 and Cst2 connected to the load lamps. In FIG. 11, the connections among the load lamps, stabilizing capacitors Cst1 and Cst2 and auxiliary capacitors Cb1 and Cb2 may be made in a similar manner to those in FIGS. 8 and 9.

The above-mentioned power-factor correction system employs the power transformer PT in the resonant inverter 2 with an induced voltage relatively much higher in level than the voltage from the DC voltage supply circuit, directly as an input power-factor improvement stage. Alternatively, in accordance with a ninth embodiment of the present invention, a high power-factor electronic ballast may be implemented as shown in FIG. 12 by appending an auxiliary winding N3 to the power transformer PT in the resonant inverter 2 to generate a high-frequency voltage of a level nearly equal to that of the voltage from the DC voltage supply circuit.

Figure 12:
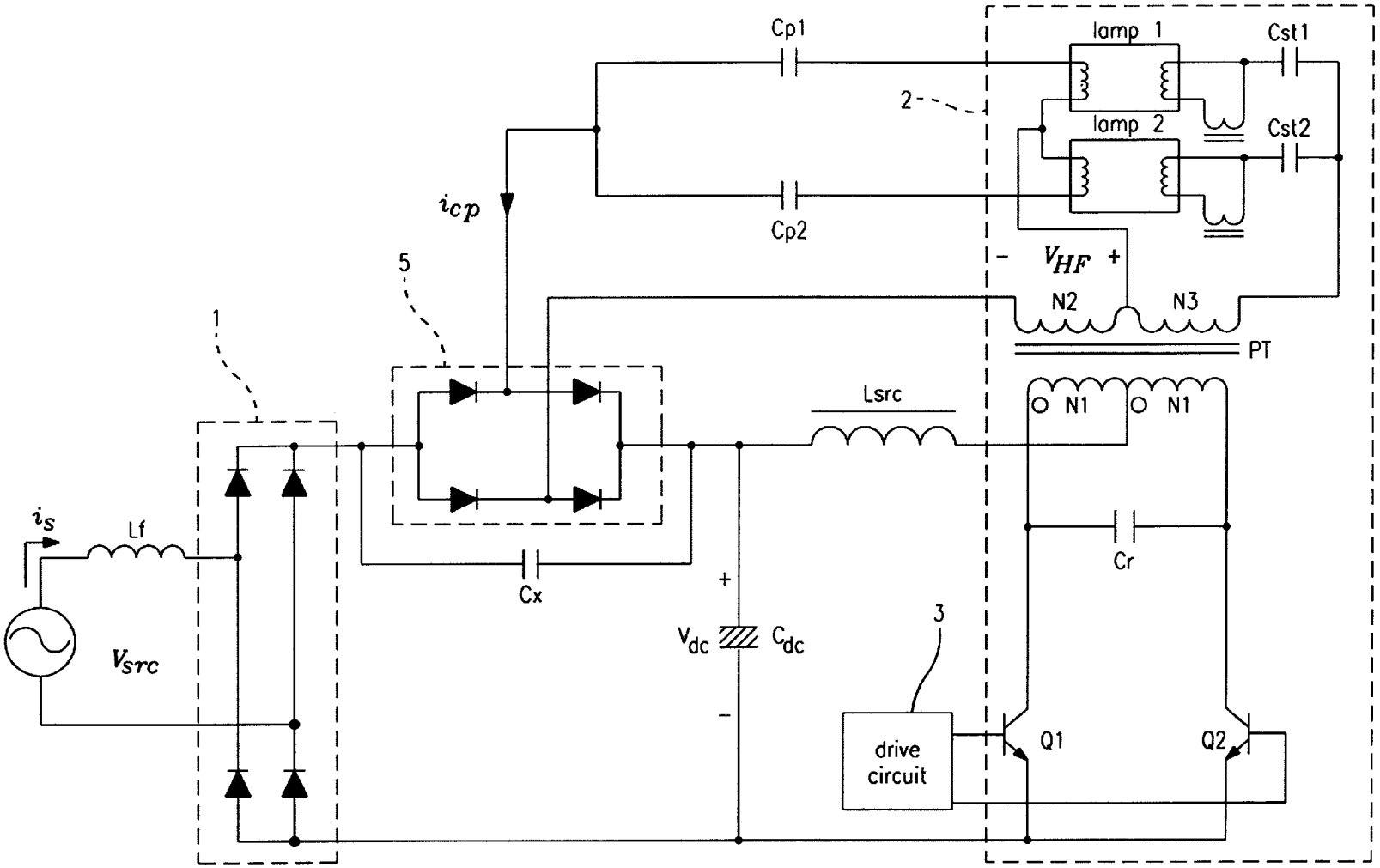
FIG. 12 is a circuit diagram showing the construction of an electronic ballast in accordance with a ninth embodiment of the present invention.

FIG. 12 is a circuit diagram showing the construction of a high power-factor electronic ballast for fluorescent lamps employing a resonant inverter of a current source type. As shown in this drawing, a input power source and an input filter Lf are connected to the input of an input full-wave rectification circuit 1, and a high-frequency full-wave rectification circuit 5 and high-frequency component filtering capacitor Cx are inserted between a DC-link capacitor Cdc and the input full-wave rectification circuit 1. An inductor Lsrc is designed to have such a large inductance as to convert a voltage across the DC-link capacitor Cdc into the form of a current source. The resonant inverter is driven in a self-excited manner to turn on the fluorescent lamps through high-frequency resonance.

A power transformer PT has a secondary winding consisting of three parts. The first secondary winding part is a winding N2 having a turn ratio of about 2/Π with a primary winding N1 of the power transformer PT, the second secondary winding part is a winding N3 having such a large number of turns as to apply appropriate voltages across the fluorescent lamps for the starting thereof and at the normal state thereof, and the third secondary winding part is a winding for the preheating of filaments of the fluorescent lamps.

The winding N2 has its one end connected to one pole of the high-frequency full-wave rectification circuit 5 in the power-factor correction circuit and its other end connected to a common connection point of first filament terminals of first electrodes of two fluorescent lamps lamp1 and lamp2 whose second filament terminals are connected in common to the other pole of the high-frequency full-wave rectification circuit 5 respectively through charge pumping capacitors Cp1 and Cp2. Because current from the winding N2 flows through the filaments of the fluorescent lamps, the power supply is automatically controlled even under a light load condition where at least one of the turned-on fluorescent lamps is turned off. In other words, values of input current and input power are determined according to capacitances of the charge pumping capacitors Cp1 and Cp2, which are in turn determined according to the number of turned-on lamps on at the time that arbitrary lamps are turned off.

In the electronic ballast of the current source type shown in FIG. 12, the high-frequency full-wave rectification circuit 5 acts as a more important part than a half-wave rectification circuit in reducing the amount of current flowing to the filaments to an appropriate degree when a plurality of lamps, for example, two lamps or more are required to be driven. The construction of FIG. 12 can be applied to an electronic ballast for the driving of two lamps or more by connecting the lamps in parallel and, then, filaments of the lamps to the high-frequency full-wave rectification circuit 5 respectively via the charge pumping capacitors Cp1, Cp2, . . . , to implement the same power-factor improving operation and power control operation. Therefore, the construction of FIG. 12 can be considered to be very suitable to a multi-lamp electronic ballast.

In the above circuitry of FIG. 12, a sinusoidal wave voltage with the same peak-to-peak voltage level as a DC-link voltage level appears at a high frequency across the secondary winding N2 of the resonant inverter. This signifies that an individual high-frequency voltage source $V_{HF}$ is formed across the winding N2.

The input voltage Vsrc can be considered to be almost constant in level for one cycle of the high-frequency voltage $V_{HF}$ across the winding N2 because the input voltage Vsrc has a frequency of 50–60 Hz and the high-frequency voltage $V_{HF}$ has a frequency of several tens Khz. At this time, if the high-frequency voltage $V_{HF}$ across the winding N2 is changed to an AC form, then voltages with peak values corresponding to the level of the input voltage Vsrc are formed across the charge pumping capacitors Cp1 and Cp2 at the same high frequency as that of the voltage $V_{HF}$, respectively, and currents icp1 and icp2 of the amounts corresponding to differentiated values of the formed voltages thus flow to the capacitors Cp1 and Cp2, respectively.

It should be noted that the charge pumping capacitors Cp1 and Cp2 can be coupled directly with the high-frequency voltage $V_{HF}$ because the voltage $V_{HF}$ is in the form of a sinusoidal wave. Provided that the voltage $V_{HF}$ is in the form of a square wave, a differentiated waveform will be a pulse form. In order to prevent this phenomenon, a large and expensive inductor must be used instead of the capacitor. The current icp is in the form of a sinusoidal wave and varies in level with the input voltage. As a result, current of the same waveform as that of the input voltage can be formed for one cycle of 60 Hz through an appropriate filtering operation.

As apparent from the above description, according to the present invention, for the implementation of a power-factor correction circuit of an electronic ballast for fluorescent lamps, a transformer of a resonant inverter in the electronic ballast is utilized, only capacitors are used with no necessity for an inductor and no separate power control circuit is required. Therefore, a high power-factor electronic ballast can be implemented at a low cost with no necessity for additional components for the power-factor improvement.

Further, according to the present invention, the power-factor correction circuit performs a self power control function for automatically controlling power supply according to the number of fluorescent lamps being turned on. This has the effect of ensuring a stable operation of the electronic ballast.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A power-factor correction circuit of an electronic ballast for fluorescent lamps which includes an input full-wave rectification circuit for full-wave rectifying an AC input voltage from an AC input power source, a first DC-link capacitor for supplying a DC-link voltage in response to an output voltage from said rectification circuit and a resonant inverter connected in parallel to said first DC-link capacitor, comprising:

charge pumping means disposed between said AC input power source and said rectification circuit, said charge pumping means including a pair of charge pumping capacitors connected in series to each other and connected at their intermediate connection point to an intermediate connection point of a pair of series connected resonance capacitors in said resonant inverter;

valley-fill DC voltage supply means disposed between said rectification circuit and said first DC-link capacitor, said DC voltage supply means including second and third DC-link capacitors, a pair of intermediate diodes for interconnecting said second and third DC-link capacitors, and a valley charge pumping capacitor connected between an intermediate connection point of said intermediate diodes and an intermediate connection point of a primary winding of a power transformer in said resonant inverter; and high-frequency full-wave rectification means disposed between said valley-fill DC voltage supply means and said first DC-link capacitor and connected to a secondary winding of said power transformer in said resonant inverter, said high-frequency full-wave rectification means including a first pole connected to said secondary winding of said power transformer and a second pole connected to a common connection point of a plurality of stabilizing capacitors, each of said stabilizing capacitors being connected in series to a corresponding one of said fluorescent lamps to stabilize lamp current.

2. The power-factor correction circuit as set forth in claim 1, wherein said fluorescent lamps have first and second electrodes short-circuited through filaments, respectively, said first electrodes being connected in common to said secondary winding of said power transformer, said second electrodes being connected respectively to said stabilizing capacitors.

3. The power-factor correction circuit as set forth in claim 1, wherein said intermediate connection point of said charge pumping capacitors in said charge pumping means is connected to said intermediate connection point of said primary winding of said power transformer in said resonant inverter; and wherein said valley charge pumping capacitor in said valley-fill DC voltage supply means is connected to said intermediate connection point of said resonance capacitors in said resonant inverter.

4. The power-factor correction circuit as set forth in claim 1, wherein said valley-fill DC voltage supply means includes:

a valley diode connected in series to said third DC-link capacitor, said second DC-link capacitor being connected at its negative terminal to an intermediate connection point of said valley diode and third DC-link capacitor, said high-frequency full-wave rectification means being connected between a cathode of said valley diode and a positive terminal of said second DC-link capacitor; and a secondary coil appended to a current supply inductor connected between said positive terminal of said second DC-link capacitor and said resonant inverter, said secondary coil having its one terminal connected to said intermediate connection point of said valley diode and third DC-link capacitor via a rectifying diode and its other terminal connected to a ground terminal.

5. The power-factor correction circuit as set forth in claim 4, wherein said valley-fill DC voltage supply means includes a pair of high-frequency diodes connected in series between an intermediate connection point of said third DC-link capacitor and second DC-link capacitor and said ground terminal, said valley charge pumping capacitor being connected between an intermediate connection point of said high-frequency diodes and said intermediate connection point of said primary winding of said power transformer.

6. The power-factor correction circuit as set forth in claim 4, wherein said valley-fill DC voltage supply means includes a pair of high-frequency diodes connected in series between an intermediate connection point of said third DC-link capacitor and second DC-link capacitor and said ground terminal for charging said third DC-link capacitor, said valley charge pumping capacitor being connected between an intermediate connection point of said high-frequency diodes and said intermediate connection point of said resonance capacitors in said resonant inverter.

7. The power-factor correction circuit as set forth in claim 1, further comprising:

a plurality of auxiliary capacitors for improving a crest factor of said lamp current; and said fluorescent lamps including first and second electrodes, respectively, each of said first and second electrodes having first and second filament terminals, said first filament terminals of said first and second electrodes being connected respectively to said auxiliary capacitors, said second filament terminals of said first electrodes being connected in common to said secondary winding of said power transformer, said second filament terminals of said second electrodes being connected respectively to said stabilizing capacitors.

8. The power-factor correction circuit as set forth in claim 1, further comprising:

a plurality of auxiliary capacitors for improving a crest factor of said lamp current;

said fluorescent lamps including their first electrodes having first filament terminals connected respectively to first terminals of said auxiliary capacitors and second filament terminals connected in common to one terminal of said secondary winding of said power transformer, and their second electrodes having first filament terminals connected respectively to first terminals of said stabilizing capacitors;

a plurality of auxiliary windings, each being connected between an intermediate connection point of each of said first filament terminals of said second electrodes of said fluorescent lamps and each of said first terminals of said stabilizing capacitors and a corresponding one of second filament terminals of said second electrodes of said fluorescent lamps, each of said auxiliary windings having a smaller number of turns than that of said secondary winding of said power transformer;

said auxiliary capacitors and said stabilizing capacitors having their second terminals connected in common to an intermediate point of said second pole of said high-frequency full-wave rectification means; and said secondary winding of said power transformer having its other terminal connected to an intermediate point of said first pole of said high-frequency full-wave rectification means.

9. A power-factor correction circuit of an electronic ballast for fluorescent lamps which includes a full-wave rectification circuit for full-wave rectifying an AC input voltage from an AC input power source, a DC-link capacitor for supplying a DC-link voltage in response to an output voltage from said full-wave rectification circuit and a resonant inverter of a current source type connected in parallel to said DC-link capacitor, comprising:

high-frequency full-wave rectification means disposed between said full-wave rectification circuit and said DC-link capacitor and connected to a secondary winding of a power transformer in said resonant inverter, said high-frequency full-wave rectification means including a first pole connected to said secondary winding of said power transformer and a second pole connected to a common connection point of a plurality of stabilizing capacitors, each of said stabilizing capacitors being connected in series to a corresponding one of said fluorescent lamps to stabilize lamp current; and a bypass capacitor connected between an intermediate connection point of said first pole of said high-frequency full-wave rectification means and said secondary winding of said power transformer and an intermediate connection point of said second pole of said high-frequency full-wave rectification means and said common connection point of said stabilizing capacitors.

10. The power-factor correction circuit as set forth in claim 9, further comprising an auxiliary winding electrically isolated from a primary winding of said power transformer in said resonant inverter of the current source type and appended to said secondary winding of said power transformer for generating a high-frequency voltage of a level nearly equal to that of said DC-link voltage from said DC-link capacitor, said auxiliary winding having its one end connected to said first pole of said high-frequency full-wave rectification means and its other end connected to a common connection point of first filament terminals of first electrodes of said fluorescent lamps whose second filament terminals are connected in common to said second pole of said high-frequency full-wave rectification means respectively through a plurality of charge pumping capacitors, said fluorescent lamps having second electrodes connected in common to said secondary winding of said power transformer respectively through said stabilizing capacitors, whereby said auxiliary winding is connected to said high-frequency full-wave rectification means through said charge pumping capacitors in the case where said fluorescent lamps are connected in parallel.

* * * * *